US006378143B2

(12) United States Patent
Battiston et al.

(10) Patent No.: US 6,378,143 B2
(45) **Date of Patent: *Apr. 30, 2002**

(54) FOLDABLE COMMODE

(75) Inventors: Joseph Battiston, Chester; David Battiston, Midlothian, both of VA (US)

(73) Assignee: Tubular Fabricators Industry, Petersburg, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/476,277

(22) Filed: Jan. 3, 2000

Related U.S. Application Data

(63) Continuation of application No. 09/072,869, filed on May 5, 1998, now Pat. No. 6,009,571.

(51) Int. Cl.[7] ..... A47K 11/06
(52) U.S. Cl. ..... 4/483; 4/479
(58) Field of Search ..... 4/484, 479, 483, 4/571.1, 573.1, 575.1, 578.1, 579, 611; 297/16.2, 42, 46, 47, 59, 35, 16.1, 23

(56) References Cited

U.S. PATENT DOCUMENTS

| | | | | | |
|---|---|---|---|---|---|
| 223,574 | A | * | 1/1880 | Baker | 4/483 |
| 780,007 | A | * | 1/1905 | Mettler | 297/47 |
| 1,482,073 | A | * | 1/1924 | Ferdinand | 4/483 |
| 3,105,665 | A | * | 10/1963 | Starkweather | 4/484 |
| 4,823,412 | A | * | 4/1989 | Spiegel | 4/483 |

* cited by examiner

*Primary Examiner*—David J. Walczak
(74) *Attorney, Agent, or Firm*—Klauber & Jackson

(57) ABSTRACT

A foldable commode which includes: a platform having a pair of slotted members depending from the bottom, each slotted member defining a race extending from front to rear; a first U-shaped leg member having a pair of legs connected by a bight portion slidably disposed in the races; a second U-shaped leg member having a pair of legs connected by a bight portion, the top portions being pivotally mounted on opposite sides of the rear end of the platform, wherein the middle portion of each of the legs of the second U-shaped leg member is pivotally attached to the middle portion of a respective one of the legs of the first U-shaped leg member; a receptacle support member disposed intermediate the front and rear ends of the platform; and a receptacle which depends from the receptacle support member.

43 Claims, 8 Drawing Sheets

FOLDABLE COMMODE

This application is a continuation of Ser. No. 09/072,869, filed May 5, 1998 now U.S. Pat. No. 6,009,571.

FIELD OF THE INVENTION

The present invention relates generally to commodes and, more particularly, but not by way of limitation, to a novel foldable commode. The present invention concerns commodes in general, and more particularly, but not by way of limitation, to chair commodes.

BACKGROUND OF THE INVENTION

Persons who are infirm, disabled, invalid, or physically limited in some way, even if only temporarily, often must use a commode.

One primary consideration for such a commode is the space available in the room, building, or facility for maneuvering, positioning, and/or storing the device. Typically, a user is faced with a minimum of open space or storage space. While maneuvering the commode, the user or caretaker would likely collide with nearby furniture, a wall, or a fixture. The transporting of the commode into and out of a particular area becomes a necessity when other users of the area cannot, or do not wish to, utilize the assistance of the commode.

Furthermore, such a commode should be relatively self-contained in order to reduce or prevent excessive protruding or extending of various portions of the device, thereby minimizing unintentional contact between the device and the user and/or the often cramped surroundings.

Moreover, such a device should be capable of manipulation by a single user without the aid of tools.

One object of the present invention is to provide a foldable commode which is easy to use and maneuver.

Another object of the present invention is to provide a foldable commode which adequately supports a user.

Yet another object of the present invention is to provide a foldable commode which is deployable by a single user without tools.

Still another object of the present invention is to provide a foldable commode which is self-contained.

A still further object of the present invention is to provide a foldable commode which is not unwieldy, and which is convenient to use in a cramped setting.

Another object of the present invention is to provide a foldable commode which can lie generally flat when folded.

Other objects of the present invention, as well as particular features, elements, and advantages thereof, will be elucidated in, or be apparent from, the following description and the accompanying drawing figures.

SUMMARY OF THE INVENTION

In a first aspect, the present invention provides a foldable commode comprising a foldable frame, the foldable frame including: a first leg means having a top portion and a bottom portion; a second leg means having a top portion and a bottom portion, wherein the first and second leg means are pivotally attached to one another intermediate respective top and bottom portions; and a platform having a front end, a rear end, a top, and a bottom, the platform including an attachment member disposed on the bottom surface which defines a race for receiving the top portion of the first leg means, thereby slidably attaching the first leg means to the platform. The rear end of the platform is pivotally attached to the upper portion of the second leg means. The foldable frame is capable of being moved between a fully closed position and a fully open position. In the fully closed position, the first and second leg means are substantially disposed adjacent the platform. In the fully open position, the first and second leg means generally criss-cross each other and generally extend away from the platform. Thus, the top portions of each of the leg means is prevented from separating from the platform.

The platform further preferably includes a receptacle support means disposed intermediate the front and rear ends of the platform, and a receptacle may depend from the receptacle support means.

The foldable frame may further comprise a seat assembly pivotally attached to the platform. The seat assembly may comprise a seat having an inner perimeter which defines an opening therethrough. The seat assembly may include a pivotable lid disposed over the seat.

In one preferred embodiment, the attachment member comprises a pair of U-shaped brackets which depend downwardly from the bottom surface of the platform.

The foldable frame also preferably may includes a pair of armrests disposed on top of the platform.

In a preferred embodiment, the first leg means is a substantially U-shaped leg member having a bight portion slidably disposed in the race formed by the attachment member.

In the fully open position, the top portion of the first leg means may extends distally substantially beyond the top of the platform in order to form a backrest.

The platform may also include releasable locking means for releasably locking the top portion of the first leg means in a desired location. The releasable locking means may releasably lock the top portion of the first leg means proximate the rear end of the platform in the fully closed position, and/or the releasable locking means may releasably lock the top portion of the first leg means proximate the front end of the platform in the fully open position.

In another preferred embodiment, the present invention comprises a foldable commode comprising: a platform having a front end, a rear end, a top, and a bottom, the platform including a pair of slotted members disposed on the bottom, each slotted member defining a race extending from the front end to the rear end, the platform being provided with a through opening; a first pair of legs, each of the legs having a top portion, a middle portion, and a bottom portion, the top portions being slidably disposed in respective races; and a second pair of legs, each of the legs having a top portion, a middle portion, and a bottom portion, the top portions being pivotally mounted on opposite sides of the rear end of the platform, wherein the middle portion of each of the second pair of legs is pivotally attached to the middle portion of a respective one of the first pair of legs. In a fully closed position, the first and second pairs of legs are disposed substantially adjacent the platform. In a fully open position, the first and second pairs of legs generally criss-cross each other. Thus, the top portions of each of the leg means is prevented from separating from the platform, and the foldable commode assumes a folded state when the first and second pairs of legs are in the fully closed position.

The platform may further preferably include a receptacle support means disposed intermediate the front and rear ends, the receptacle support means surrounding the through opening. A receptacle may depend from the receptacle support means.

The foldable commode may also include a seat assembly pivotally attached to the platform. The seat assembly may include a seat having an inner perimeter which defines a seat opening therethrough, wherein the seat opening is generally positioned over the through opening in the platform. The seat assembly may also further include a pivotable lid disposed on top of the seat.

In a particular embodiment, each of the slotted members comprises a U-shaped bracket attached to the bottom of the platform, whereby the U-shaped brackets and the bottom of the platform form the races.

The foldable commode may also include a pair of armrests disposed on top of the platform.

The first pair of legs may comprise a substantially U-shaped leg member having a bight portion slidably disposed in the race formed by the attachment member.

In the fully open position, the top portion of the first pair of legs extends upwardly substantially above the top of the platform, thereby forming a backrest.

The platform may also comprise releasable locking means for releasably locking the top portion of the first pair of legs in a desired location. The releasable locking means may releasably lock the top portion of the first pair of legs proximate the rear end of the platform in the fully closed position, and/or the releasable locking means may releasably lock the top portion of the first pair of legs proximate the front end of the platform in the fully open position.

In a particular embodiment, the releasable locking means may include at least one clamp.

In one preferred embodiment, the top portions of the first pair of legs are attached to each other. The first pair of legs may include a connecting portion which connects the top portion of each of the first pair of legs and which is slidably disposed in the races. The first pair of legs may have a substantially U-shape.

In a particular embodiment, the second pair of legs are attached to each other. The second pair of legs may include a connecting portion which connects the top portion of each of the second pair of legs. The second pair of legs may have a substantially U-shape.

In another preferred embodiment, the presention invention relates to a foldable commode comprising: a platform having a front end, a rear end, a top, and a bottom, the platform including a pair of slotted members depending from the bottom, each slotted member defining a race extending from the front end to the rear end, the platform being provided with a through opening; a first inverted U-shaped leg member having a pair of legs connected by a bight portion, each of the legs having a top portion, a middle portion, and a bottom portion, the bight portion being slidably disposed in the races; a second inverted U-shaped leg member having a pair of legs connected by a bight portion, each of the legs having a top portion, a middle portion, and a bottom portion, the top portions being pivotally mounted on opposite sides of the rear end of the platform, wherein the middle portion of each of the legs of the second inverted U-shaped leg member is pivotally attached to the middle portion of a respective one of the legs of the first inverted U-shaped leg member; a receptacle support means disposed intermediate the front and rear ends, the receptacle support means surrounding the through opening; and a receptacle which depends from the receptacle support means.

In a fully closed position, the first and second pairs of legs are disposed substantially adjacent the platform. In a fully open position, the first and second pairs of legs generally criss-cross each other. Thus, the top portions of each of the leg means is prevented from separating from the platform, and the foldable commode assumes a folded state when the first and second pairs of legs are in the fully closed position.

The seat assembly may be pivotally attached to the platform. The seat assembly may include a pivotable lid disposed on top of the seat.

The commode may include a pair of armrests disposed on top of the platform.

A tissue roll holder may be attached to at least one of the armrests.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which:

FIG. 1 is a perspective view of a foldable commode according to the present invention in the fully open position;

FIG. 2 is a side view of a foldable frame which is a part of the foldable commode of FIG. 1;

FIG. 3 is a front view of the foldable frame of FIG. 2;

FIG. 4 is a top view of the foldable frame of FIG. 2;

FIG. 5 is a side view of the foldable frame of FIG. 2 in a partially closed position;

FIG. 6 is a side view of the foldable frame of FIG. 2 in a fully closed position;

FIG. 7 is a front view of the foldable commode of FIG. 1, shown without the lid assembly for purposes of clarity of illustration; and FIG. 8 is a top view of the foldable commode of FIG. 7.

DETAILED DESCRIPTION OF THE PREFERRED EMBODIMENTS

Figure 1:
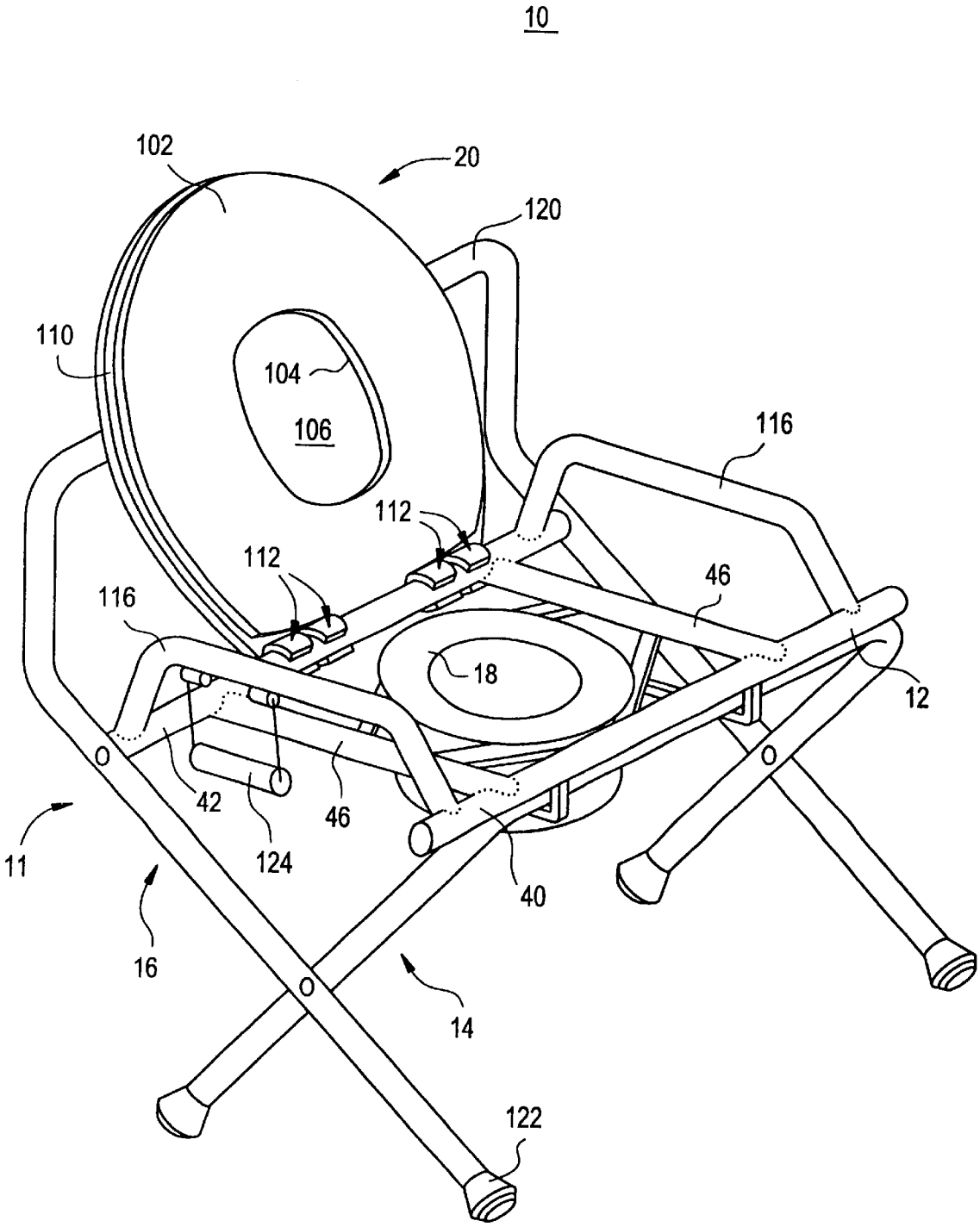
FIGS. 1–8 illustrate one particular embodiment a foldable commode according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

In one preferred embodiment, the present invention provides a foldable commode comprising a foldable frame, the foldable frame including: a first leg means having a top portion and a bottom portion; a second leg means having a top portion and a bottom portion, wherein the first and second leg means are pivotally attached to one another intermediate respective top and bottom portions; and a platform having a front end, a rear end, a top, and a bottom, the platform including an attachment member disposed on the bottom surface which defines a race for receiving the top portion of the first leg means, thereby slidably attaching the first leg means to the platform. The rear end of the platform is pivotally attached to the upper portion of the second leg means. The foldable frame is capable of being moved between a fully closed position and a fully open position. In the fully closed position, the first and second leg means are substantially disposed adjacent the platform. In the fully open position, the first and second leg means generally criss-cross each other and generally extend away from the platform. Thus, the top portions of each of the leg means is prevented from separating from the platform.

The platform further preferably includes a receptacle support means disposed intermediate the front and rear ends of the platform, and a receptacle may depend from the receptacle support means.

The foldable frame may further comprise a seat assembly pivotally attached to the platform. The seat assembly may comprise a seat having an inner perimeter which defines an opening therethrough. The seat assembly may include a pivotable lid disposed over the seat.

In one preferred embodiment, the attachment member comprises a pair of U-shaped brackets which depend downwardly from the bottom surface of the platform.

The foldable frame also preferably may includes a pair of armrests disposed on top of the platform.

In a preferred embodiment, the first leg means is a substantially U-shaped leg member having a bight portion slidably disposed in the race formed by the attachment member.

In the fully open position, the top portion of the first leg means may extends distally substantially beyond the top of the platform in order to form a backrest.

The platform may also include releasable locking means for releasably locking the top portion of the first leg means in a desired location. The releasable locking means may releasably lock the top portion of the first leg means proximate the rear end of the platform in the fully closed position, and/or the releasable locking means may releasably lock the top portion of the first leg means proximate the front end of the platform in the fully open position.

In another preferred embodiment, the present invention comprises a foldable commode comprising: a platform having a front end, a rear end, a top, and a bottom, the platform including a pair of slotted members disposed on the bottom, each slotted member defining a race extending from the front end to the rear end, the platform being provided with a through opening; a first pair of legs, each of the legs having a top portion, a middle portion, and a bottom portion, the top portions being slidably disposed in respective races; and a second pair of legs, each of the legs having a top portion, a middle portion, and a bottom portion, the top portions being pivotally mounted on opposite sides of the rear end of the platform, wherein the middle portion of each of the second pair of legs is pivotally attached to the middle portion of a respective one of the first pair of legs. In a fully closed position, the first and second pairs of legs are disposed substantially adjacent the platform. In a fully open position, the first and second pairs of legs generally criss-cross each other. Thus, the top portions of each of the leg means is prevented from separating from the platform, and the foldable commode assumes a folded state when the first and second pairs of legs are in the fully closed position.

The platform may further preferably include a receptacle support means disposed intermediate the front and rear ends, the receptacle support means surrounding the through opening. A receptacle may depend from the receptacle support means.

The foldable commode may also include a seat assembly pivotally attached to the platform. The seat assembly may include a seat having an inner perimeter which defines a seat opening therethrough, wherein the seat opening is generally positioned over the through opening in the platform. The seat assembly may also further include a pivotable lid disposed on top of the seat.

In a particular embodiment, each of the slotted members comprises a U-shaped bracket attached to the bottom of the platform, whereby the U-shaped brackets and the bottom of the platform form the races.

The foldable commode may also include a pair of armrests disposed on top of the platform.

The first pair of legs may comprise a substantially U-shaped leg member having a bight portion slidably disposed in the race formed by the attachment member.

In the fully open position, the top portion of the first pair of legs extends upwardly substantially above the top of the platform, thereby forming a backrest.

The platform may also comprise releasable locking means for releasably locking the top portion of the first pair of legs in a desired location. The releasable locking means may releasably lock the top portion of the first pair of legs proximate the rear end of the platform in the fully closed position, and/or the releasable locking means may releasably lock the top portion of the first pair of legs proximate the front end of the platform in the fully open position.

In a particular embodiment, the releasable locking means may include at least one clamp.

In one preferred embodiment, the top portions of the first pair of legs are attached to each other. The first pair of legs may include a connecting portion which connects the top portion of each of the first pair of legs and which is slidably disposed in the races. The first pair of legs may have a substantially U-shape.

In a particular embodiment, the second pair of legs are attached to each other. The second pair of legs may include a connecting portion which connects the top portion of each of the second pair of legs. The second pair of legs may have a substantially U-shape.

In another preferred embodiment, the presention invention relates to a foldable commode comprising: a platform having a front end, a rear end, a top, and a bottom, the platform including a pair of slotted members depending from the bottom, each slotted member defining a race extending from the front end to the rear end, the platform being provided with a through opening; a first inverted U-shaped leg member having a pair of legs connected by a bight portion, each of the legs having a top portion, a middle portion, and a bottom portion, the bight portion being slidably disposed in the races; a second inverted U-shaped leg member having a pair of legs connected by a bight portion, each of the legs having a top portion, a middle portion, and a bottom portion, the top portions being pivotally mounted on opposite sides of the rear end of the platform, wherein the middle portion of each of the legs of the second inverted U-shaped leg member is pivotally attached to the middle portion of a respective one of the legs of the first inverted U-shaped leg member; a receptacle support means disposed intermediate the front and rear ends, the receptacle support means surrounding the through opening; and a receptacle which depends from the receptacle support means.

In a fully closed position, the first and second pairs of legs are disposed substantially adjacent the platform. In a fully open position, the first and second pairs of legs generally criss-cross each other. Thus, the top portions of each of the leg means is prevented from separating from the platform, and the foldable commode assumes a folded state when the first and second pairs of legs are in the fully closed position.

The seat assembly may be pivotally attached to the platform. The seat assembly may include a pivotable lid disposed on top of the seat.

The commode may include a pair of armrests disposed on top of the platform.

A tissue roll holder may be attached to at least one of the armrests.

FIGS. 1–8 illustrate one preferred embodiment of the present invention. A foldable commode 10 includes a foldable frame 11 comprised of a platform 12, a first leg means 14, and a second leg means 16, as well as a receptacle 18 and a seat assembly 20. Thus, the platform 12 and first and second leg means together form a foldable frame 11 for the other elements of the foldable commode 10, as further described hereinbelow.

FIGS. 2–6 show the foldable frame 11, i.e. the receptacle 18 and the lid assembly 20 are omitted for purposes of clarity of illustration of the other elements of the foldable commode 10.

Figure 7:
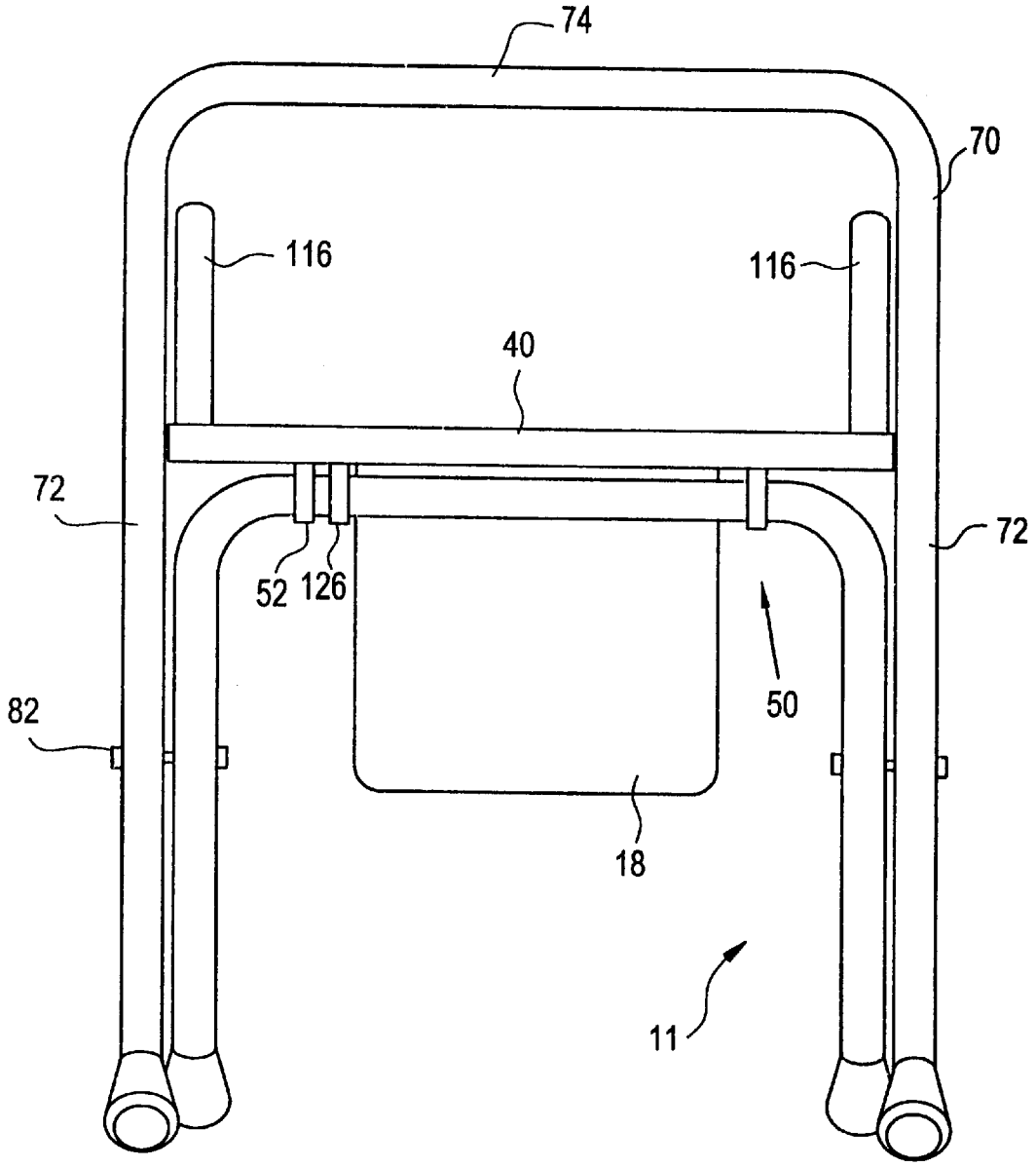
Figure 8:
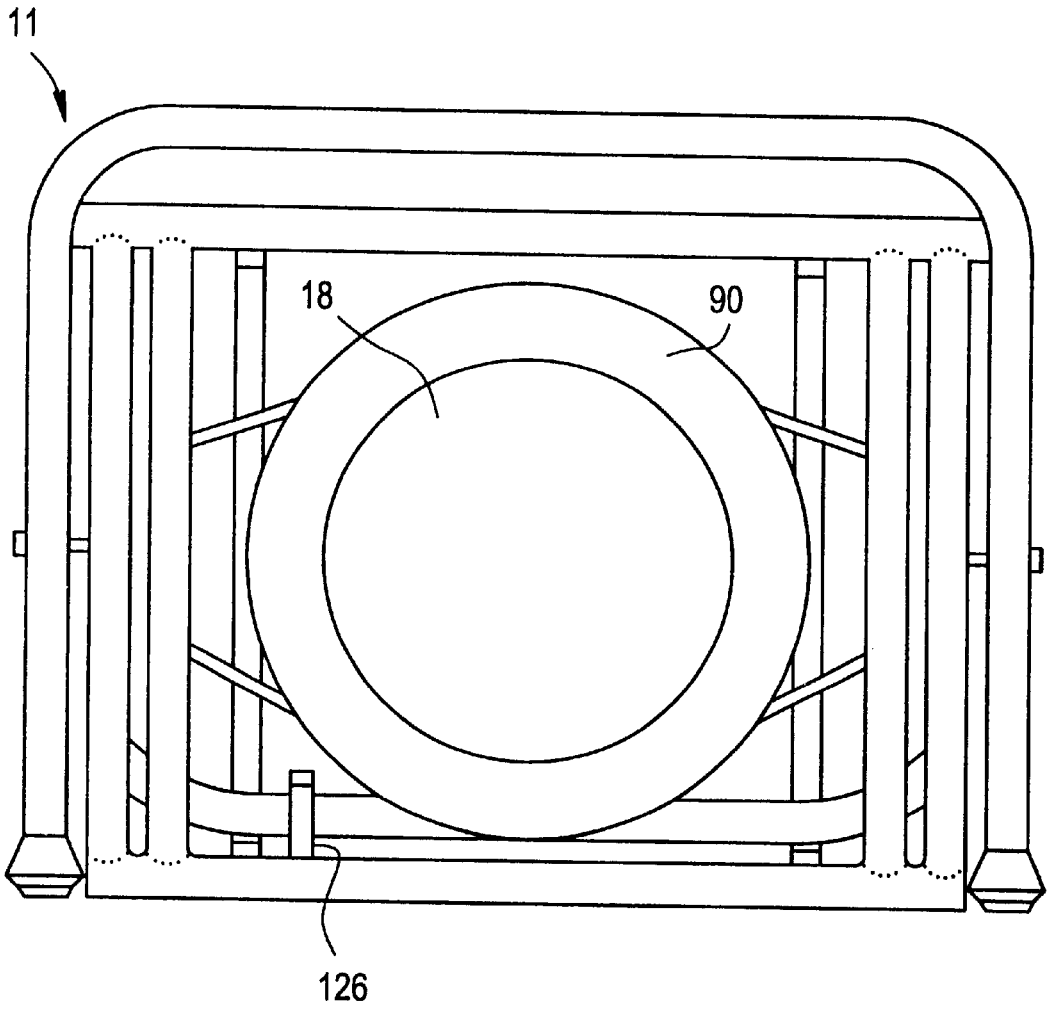

FIGS. 7–8 show the foldable commode 10, wherein the lid assembly 20 is omitted for purposes of clarity of illustration of the other elements of the foldable commode 10.

The platform 12 has a front end 30, a rear end 32, a top 34, and a bottom 36. The platform 12 comprises a front support 40, a rear support 42, and a pair of side supports 46. The platform 12 includes a means for slidingly mounting one of the leg means or an attachment means 50, or attachment member, which in this preferred embodiment, comprise a pair of U-shaped brackets or slotted members 52 depending from the bottom 36 of the platform 12, each slotted member 52 defining a race 54 extending from the front end 30 to the rear end 32. The U-shaped brackets or slotted members 52 are shown mounted between the front support 40 and the rear support 42 and depend therefrom. The framework established by the front support 40, rear support 42 and side supports 46 of the platform 12 defines a through opening 55 to be utilized by the user and into and out of which the receptacle 18 may be moved.

In the illustrated preferred embodiment of FIGS. 1–8, the first leg means 14 comprises a first inverted U-shaped leg member 60 having a pair of legs 62 connected by a connecting portion or bight portion 64, each of the legs 62 having a top portion, a middle portion, and a bottom portion, the bight portion 64 being slidably disposed in the races 54. The second leg means 16 comprises a second inverted U-shaped leg member 70 having a pair of legs 72 connected by a bight portion 74, each of the legs 72 having a top portion, a middle portion, and a bottom portion, the top portions being pivotally mounted on opposite sides of the rear end 32 of the platform 12 at pivot points 80. By way of example, if the rear support 42 is constructed from hollow tubing, then a bar or rod (not shown) may be disposed inside the rear support 42 so as to freely rotate therewithin, wherein the top portions of the second U-shaped leg members 70 may be fixedly attached to the bar or rod, thereby allowing the second leg members 70 to pivot with respect to the platform 12. The middle portion of each of the legs 72 of the second inverted U-shaped leg members 70 is pivotally attached to the middle portion of a respective one of the legs 62 of the first inverted U-shaped leg member 60 at pivot points 82.

Figure 2:
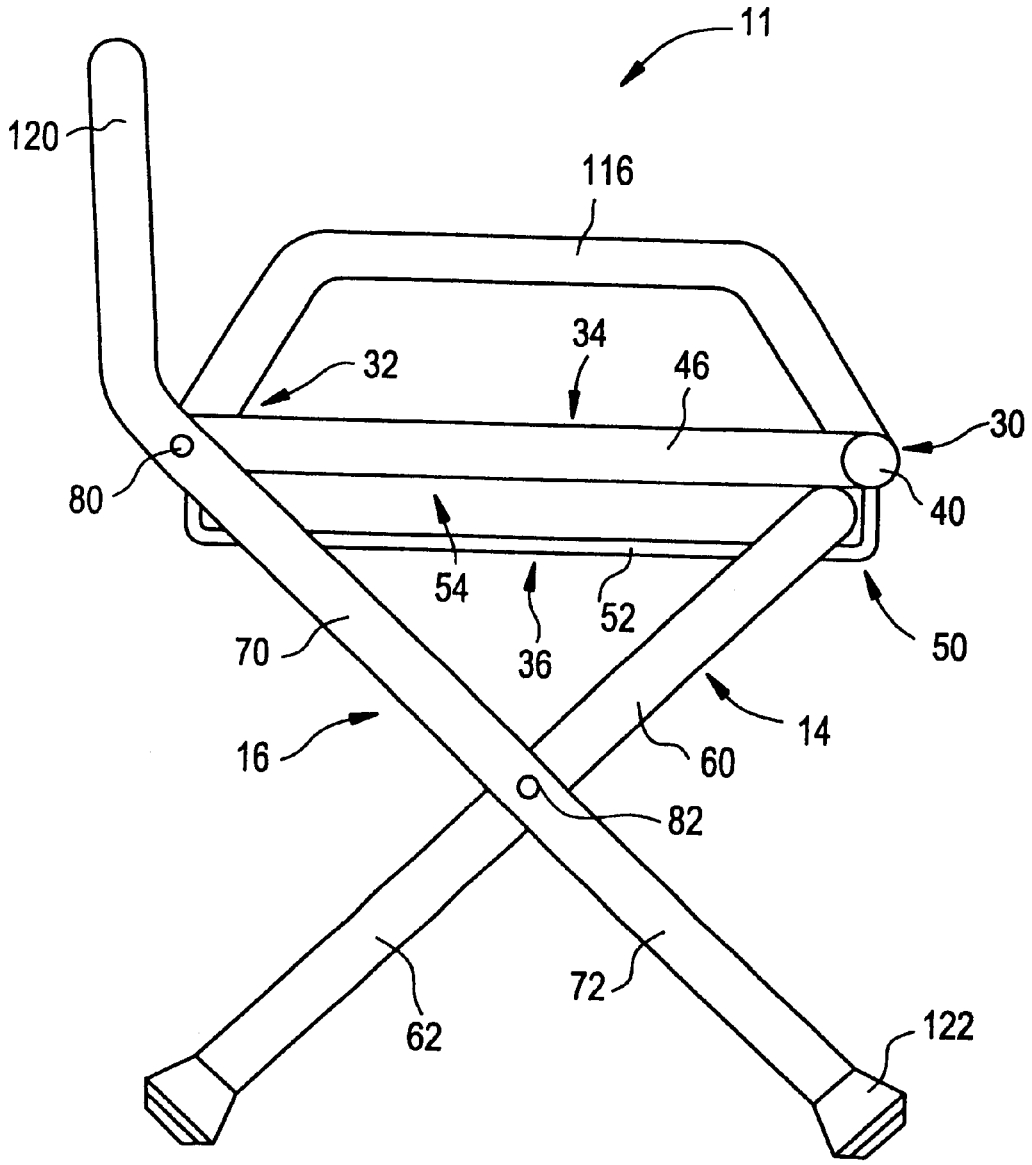

As best seen in FIG. 2, the first and second pairs of legs 62, 72 generally criss-cross each other in a fully open position.

A receptacle support means 86 is shown disposed intermediate the front and rear ends 30, 32. The receptacle support means 86 surrounds the through opening 55 such that the receptacle 18 depends from the receptacle support means 86. The receptacle 18 is preferably removably disposed in, or on, the receptacle support means 86, thereby providing ease of cleaning, sanitizing, and/or storage. The receptacle support means 86 shown in the Figures comprises two generally V-shaped support members 88 fixedly attached to the side supports 46 of the platform 12 so as to span laterally across the through opening 55 in the platform 12. Thus, a receptacle 18 may be provided with a lip 90 so that the lip 90 may engage the V-shaped support members 88 when the receptacle 18 is lowered into the through hole 55.

A seat assembly 20 may be pivotally attached to the platform 12. The seat assembly 20 preferably comprises a seat member 102 having an inner perimeter 104 which defines an opening 106 therethrough. The seat assembly 20 may also preferably comprise a pivotable lid 110 disposed over the seat 102. The seat assembly 20 may be adapted for removable attachment to the platform 12 or some other portion of the foldable frame 11.

In the Figures, the seat assembly 20, that is, both the seat member 102 and the lid 110 are pivotally mounted on the rear support 42. The seat assembly 20 may be pivotally mounted by fingers 112 which are elastic enough to allow a snap fit onto the platform 12 and which are strong enough to allow repeated use. The seat assembly 20 may be either fixedly or removedly attached to the foldable frame 11.

A pair of armrests 116 may be preferably disposed on top of the platform 12 in order to provide support and assistance to the user. Each armrest 116 is shown fixedly attached to the front support 40 and rear support 42.

Preferably, the top portion of the second leg means 16 extends distally substantially beyond the top of the platform 12, thereby forming a backrest 120. The backrest 120 may assist in limiting the backward movement of the seat assembly 20 or a part thereof.

Figure 5:
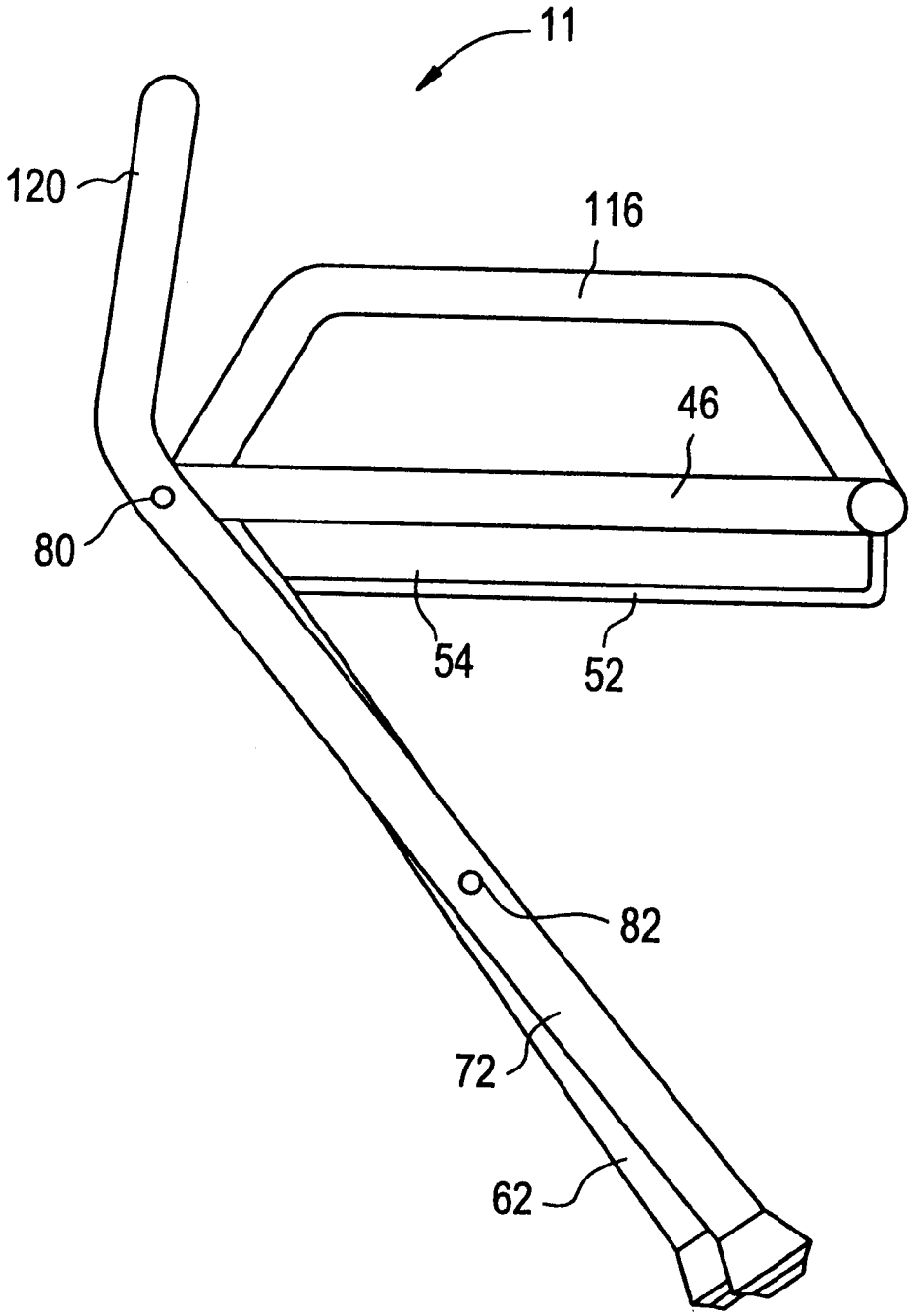

FIG. 5 shows one preferred embodiment of the present invention, without a seat assembly 20 or receptacle 18, in a partially closed state, wherein the top portion of the first leg member 60 has been slid backward in the races 54 so that the first and second leg members 60, 70 are disposed generally next to each other. In order to fully close the foldable commode 10, the platform 12 and legs 60, 70 would subsequently be pressed together.

Figure 6:
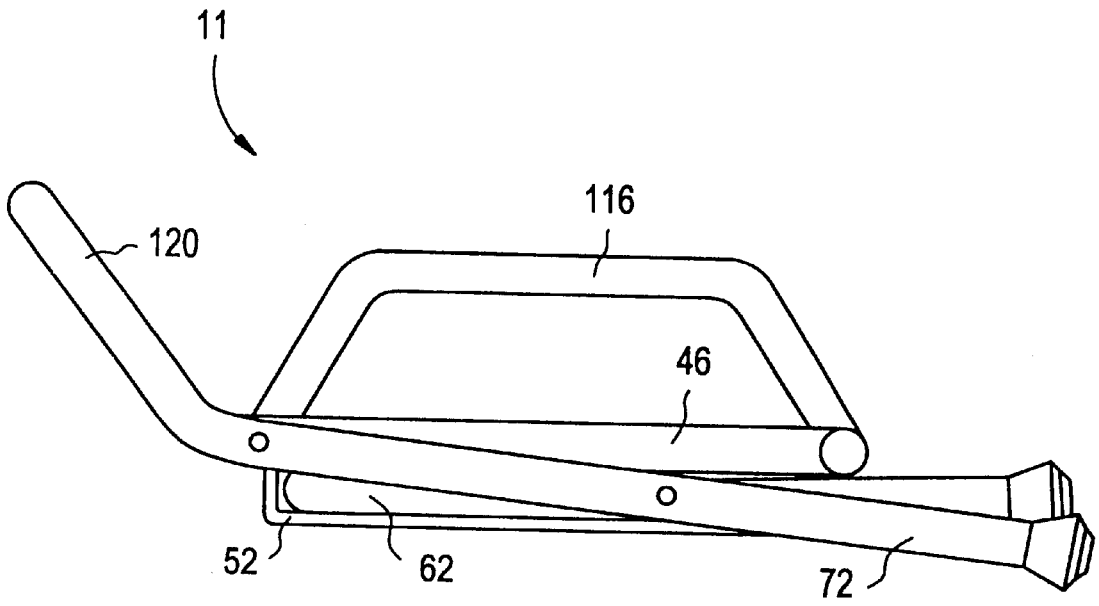

FIG. 6 shows the foldable commode 10 of the present invention in a fully closed position, wherein the first and second pairs of legs 62, 72 are disposed substantially adjacent the platform 12.

Thus, the top portions of each of the leg means 14, 16 are prevented from separating from the platform 12, and the foldable commode 10 assumes a folded state when the first and second pairs of legs 62, 72 are in the fully closed position.

FIGS. 7–8 show the receptacle 18 disposed atop, or suspended from, the receptacle support means 86.

The platform 12 may further include a releasable locking means for releasably locking the top portion of the first leg means 14 in a desired location. The releasable locking means may releasably lock the top portion of the first leg means 14 proximate the rear end of the platform 12 in the fully closed position. Alternatively, or in addition, the releasable locking means releasably may lock the top portion of the first leg means 14 proximate the front end of the platform 12 in the fully open position. The releasable locking means may comprise, for example, a clamp 126.

Preferably the foldable commode 10, and in particular, the foldable frame 11, is made from a lightweight material which is strong enough to support the weight of the intended user. Water resistant material is preferably used. Aluminum, wood, or various plastics, such as polyethylene, may be suitably utilized, especially for portions or elements which are not intended to be in direct with liquids or contaminants. The foldable commode 10 may also be fabricated from a combination of materials, such as aluminum and plastic. The foldable commode 10, especially all exposed parts thereof, is preferably formed or finished to avoid sharp points or edges.

In a particularly preferred embodiment, the foldable frame 11 is constructed from tubular members, such as tubular plastic or metal, so as to provide, for example, adequate strength and support and in order to minimize weight.

Figure 3:
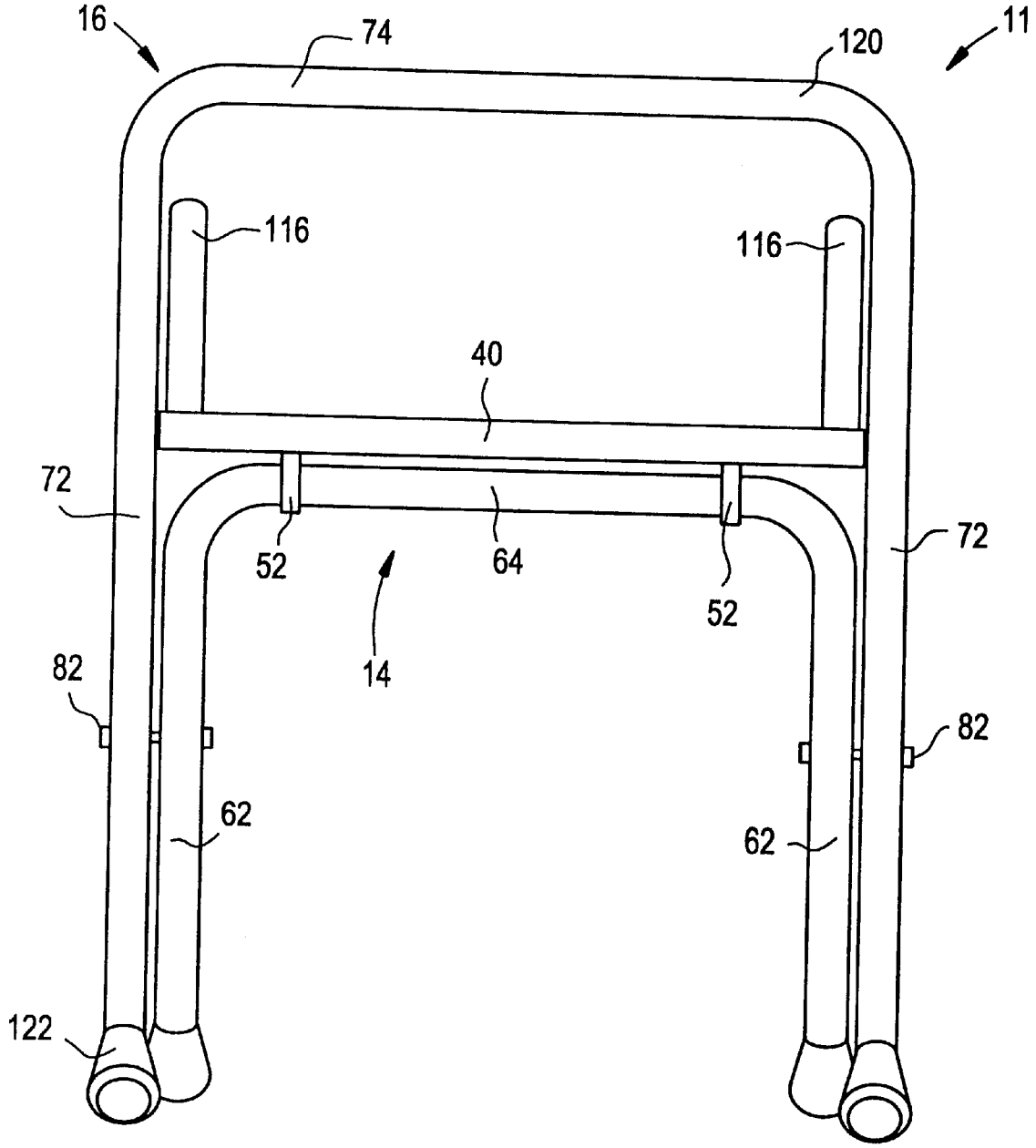

As seen, for example, in FIGS. 1–3, the first and second leg means 14, 16 are pivotally attached to one another in their middle portions, i.e. intermediate respective top and bottom portions at pivot points 82. A pivot connection means such as a rivet, rod, bolt, or some other type of connector may be used to connect the first and second leg means 14, 16.

The free distal ends of each of the legs 62, 72 may preferably be provided with an anti-skid cap 122 made from rubber or a rubber-like plastic or some other material which retards slipping between the distal ends of the legs 62, 72 and the supporting surface upon which the commode 10 is placed.

A tissue roll holder 124 may be attached to at least one of the armrests or other part of the commode 10.

Figure 4:
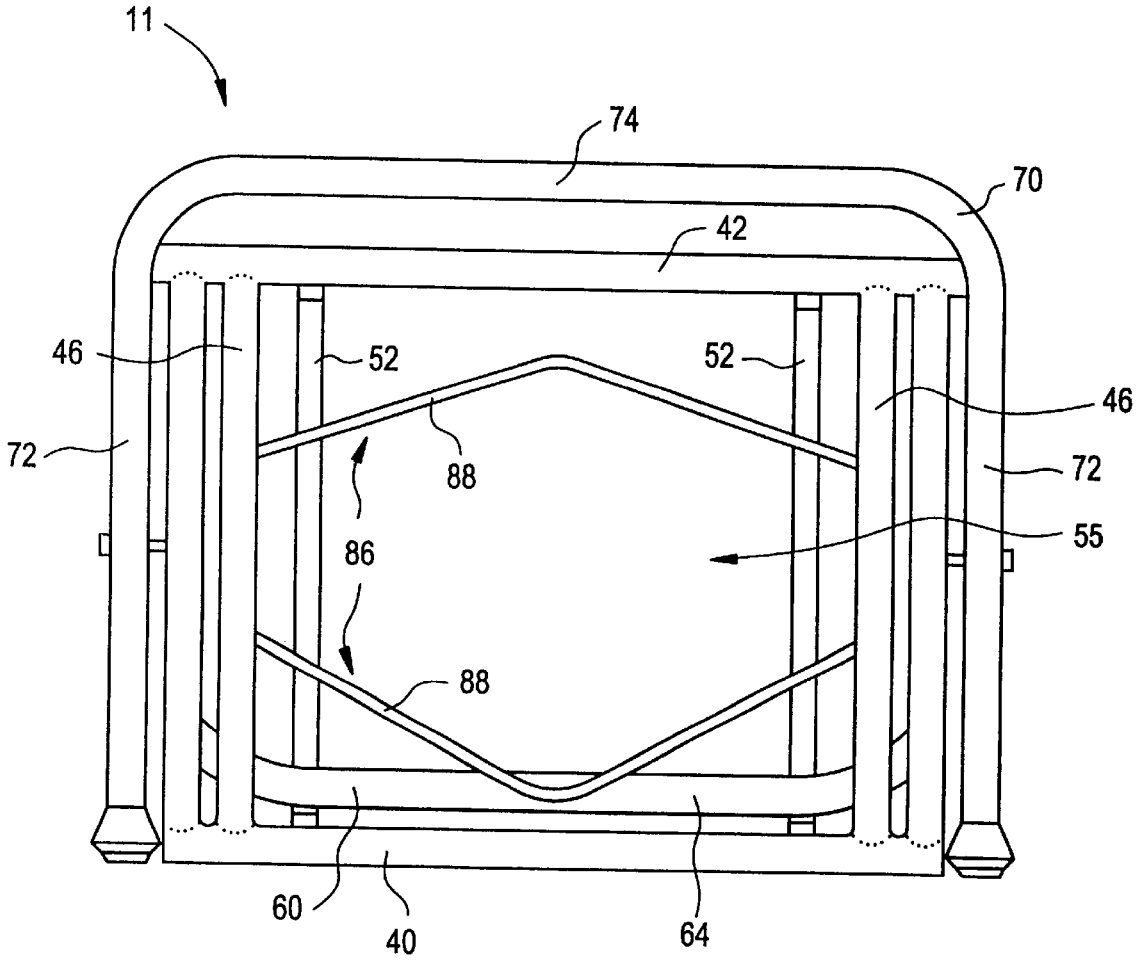

As best seen in FIGS. 2, 4 and 5, the illustrated preferred embodiment includes an attachment means 50 where each race 54 is formed from a longitudinal bar or rod 52 attached to and spaced apart from the bottom 36 of the platform 12 so that each race 54 is adapted to allow at least a part of the upper portion of the first pair of legs 62 to slide therein.

A clamp or clip may be attached to the platform 12 and over the top portion of the first leg means 14, such as over the bight portion 64 of the U-shaped first leg member 60.

Thus, the top portions of each leg means 14, 16 are contained by the attachment means 50 whether in the first resting position, the second resting position, or anywhere therebetween.

In an alternate preferred embodiment of the present invention, the first leg means 14 comprises a U-shaped leg member 60, while the second leg means 16 comprises two separate legs.

In yet another preferred embodiment of the present invention, both the first and second leg means 14,16 comprise two separate legs. For example, the top portions of the first leg means 14 may comprise a loop portion which slidably engages respective longitudinal rods disposed on the platform 12. If the legs are hollow tubes, a loop member such as an eyelet may be inserted into a leg and attached thereto.

A clamp may be provided for releasably engaging the top portion of the first leg means 14. Thus, the clamp can releasably lock the first leg means 14 in position. Preferably, the clamp is constructed of sufficient size and strength so that a user may engage and disengage the clamp using only manual power, i.e. without the assistance of tools or another person.

Preferably, the foldable frame 11 is made from a lightweight, but strong, construction. It is particularly preferable to fabricate such members from tubular aluminum or steel stock. Alternately, such members could be made from other materials such as plastic, wood, or other metals, which may or may not utilize tubular construction, depending upon a particular application.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A foldable commode comprising a foldable frame, said foldable frame including:

a first log means having a top portion and a bottom portion;

a second leg means having a top portion and a bottom portion, wherein said first and second leg means are pivotally attached to one another intermediate respective said top and bottom portions; and a platform having a front end, a rear end, a top, and a bottom surface, said platform including an attachment member disposed on the bottom surface and attached at a first end to the front end of the platform and at a second end to the rear end of the platform, said attachment member defining a race for receiving said top portion of said first leg means, thereby slidably attaching said first leg means to said platform;

wherein the rear end of said platform is pivotally attached to the upper portion of said second leg means;

wherein said foldable frame is capable of being moved between a fully closed position and a fully open position;

wherein, in the fully closed position, said first and second leg means are substantially disposed adjacent said platform; and wherein, in the fully open position, said first and second leg means generally criss-cross each other and generally extend away from said platform, said first leg means and the front end of said platform defining a cross-sectional slot therebetween along a front of the commode; and wherein the top portions of each of said leg means is prevented from separating from said platform.

2. The foldable commode according to claim 1 wherein said platform further comprises a receptacle support means disposed intermediate the front and rear ends.

3. The foldable commode according to claim 2 further comprising a receptacle wich depends from said receptacle support means.

4. The foldable commode according to claim 1 wherein said foldable frame further comprises a seat assembly pivotally attached to said platform.

5. The foldable commode according to claim 4 wherein said seat assembly comprises a seat having an inner perimeter which defines an opening therethrough.

6. The foldable commode according to claim 5 wherein said seat assembly further comprises a pivotable lid disposed over said seat.

7. The foldable commode according to claim 1 wherein said attachment member comprises a pair of U-shaped brackets which depend downwardly from the bottom surface of said platform.

8. The foldable commode according to claim 1 wherein said foldable frame further comprises a pair of armrests disposed on top of said platform.

9. The foldable commode according to claim 1 wherein said first leg means comprises a substantially U-shaped leg member having a bight portion slidably disposed in the race formed by said attachment member.

10. A foldable commode comprising a foldable frame, said foldable frame including:

a first leg means having a top portion and a bottom portion;

a second leg means having a top portion and a bottom portion, wherein said first and second leg means are pivotally attached to one another intermediate respective said top and bottom portions; and a platform having a front end, a rear end, a top, and a bottom surface, said platform including an attachment member disposed on the bottom surface which defines a race for receiving said top portion of said first leg means, thereby slidably attaching said first leg means to said platform;

wherein the rear end of said platform is pivotally attached to the upper portion of said second leg means;

wherein said foldable frame is capable of being moved between a fully closed position and a fully open position;

wherein, in the fully closed position, said first and second leg means are substantially disposed adjacent said platform; and wherein, in the fully open position, said first and second leg means generally criss-cross each other and generally extend away from said platform;

wherein the top portions of each of said leg means is prevented from separating from said platform, wherein, in the fully open position, the top portion of said second leg means extends distally substantially beyond the top of said platform, thereby forming a backrest.

11. A foldable commode comprising a foldable frame, said foldable frame including:

a first leg means having a top portion and a bottom portion;

a second leg means having a top portion and a bottom portion, wherein said first and second leg means are pivotally attached to one another intermediate respective said top and bottom portions; and a platform having a front end, a rear end, a top, and a bottom surface, said platform including an attachment member disposed on the bottom surface which defines a race for receiving said top portion of said first leg means, thereby slidably attaching said first leg means to said platform;

wherein the rear end of said platform is pivotally attached to the upper portion of said second leg means;

wherein said foldable frame is capable of being moved between a fully closed position and a fully open position;

wherein, in the fully closed position, said first and second leg means are substantially disposed adjacent said platform; and wherein, in the fully open position, said first and second leg means generally criss-cross each other and generally extend away from said platform;

wherein the top portions of each of said leg means is prevented from separating from said platform; and wherein said platform further comprises releasable locking means for releasably locking the top portion of said first leg means in a desired location.

12. The foldable commode according to claim 11 wherein said releasable locking means releasably locks the top portion of said first leg means proximate the rear end of said platform in the fully closed position.

13. The foldable commode according to claim 11 wherein said releasable locking means releasably locks the top portion of said first leg means proximate the front end of said platform in the fully open position.

14. A foldable commode comprising:

a platform having a front end, a rear end, a top, and a bottom, said platform including a pair of slotted members disposed on the bottom between the front end and the rear end, each said slotted member defining a race extending from the front end to the rear end, said platform being provided with a through opening;

a first pair of legs, each of said legs having a top portion, a middle portion, and a bottom portion, the top portions being slidably disposed in respective races; and a second pair of legs, each of said legs having a top portion, a middle portion, and a bottom portion, the top portions being pivotally mounted on opposite sides of the rear end of said platform, wherein the middle portion of each of said second pair of legs is pivotally attached to the middle portion of a respective one of said first pair of legs;

wherein, in a fully closed position, said first and second pairs of legs are disposed substantially adjacent said platform;

wherein, in a fully open position, said first and second pairs of legs generally criss-cross each other and the top portion of said first pair of legs and the front end of said platform define a cross-sectional slot therebetween along front of the commode;

wherein the top portions of each of said leg means is prevented from separating from said platform; and wherein said foldable commode assumes a folded state when said first and second pairs of legs are in the fully closed position.

15. The foldable commode according to claim 14 wherein said platform further comprises a receptacle support means disposed intermediate the front and rear ends, said receptacle support means surrounding the through opening.

16. The foldable commode according to claim 15 further comprising a receptacle which depends from said receptacle support means.

17. The foldable commode according to claim 14 further comprising a seat assembly pivotally attached to said platform.

18. The foldable commode according to claim 17 wherein said seat assembly comprises a seat having an inner perimeter which defines a seat opening therethrough, wherein the seat opening is generally positioned over the through opening in said platform.

19. The foldable commode according to claim 18 wherein said seat assembly further comprises a pivotable lid disposed on top of said seat.

20. The foldable commode according to claim 14 wherein each of said slotted members comprises a U-shaped bracket attached to the bottom of said platform, whereby said U-shaped brackets and the bottom of said platform form the races.

21. The foldable commode according to claim 14 wherein said foldable commode further comprises a pair of armrests disposed on top of said platform.

22. The foldable commode according to claim 14 wherein said first pair of legs comprises a substantially U-shaped leg member having a bight portion slidably disposed in the race formed by said attachment member.

23. A foldable commode comprising:

a platform having a front end, a rear end, a top, and a bottom, said platform including a pair of slotted members disposed on the bottom between an inner portion of the front end and an inner portion of the rear end, each said slotted member defining a race extending from the front end to the rear end, said platform being provided with a through opening;

a first pair of legs, each of said legs having a top portion, a middle portion, and a bottom portion, the top portions being slidably disposed in respective races; and a second pair of legs, each of said legs having a top portion, a middle portion, and a bottom portion, the top portions being pivotally mounted on opposite sides of the rear end of said platform, wherein the middle portion of each of said second pair of legs is pivotally attached to the middle portion of a respective one of said first pair of legs;

wherein, in a fully closed position, said first and second pairs of legs are disposed substantially adjacent said platform;

wherein, in a fully open position, said first and second pairs of legs generally criss-cross each other;

wherein the top portions of each of said leg means is prevented from separating from said platform; and wherein said foldable commode assumes a folded state when said first and second pairs of legs are in the fully closed position;

wherein, in the fully open position, the top portion of said second pair of legs extends upwardly substantially to form a backrest above the top of said platform.

24. A foldable commode comprising:

a platform having a front end, a rear end, a top, and a bottom, said platform including a pair of slotted members disposed on the bottom between an inner portion of the front end and an inner portion of the rear end, each said slotted member defining a race extending from the front end to the rear end, said platform being provided with a through opening;

a first pair of legs, each of said legs having a top portion, a middle portion, and a bottom portion, the top portions being slidably disposed in respective races; and a second pair of legs, each of said legs having a top portion, a middle portion, and a bottom portion, the top portions being pivotally mounted on opposite sides of the rear end of said platform, wherein the middle portion of each of said second pair of legs is pivotally attached to the middle portion of a respective one of said first pair of legs;

wherein, in a fully closed position, said first and second pairs of legs are disposed substantially adjacent said platform;

wherein, in a fully open position, said first and second pairs of legs generally criss-cross each other;

wherein the top portions of each of said leg means is prevented from separating from said platform; and wherein said foldable commode assumes a folded state when said first and second pairs of legs are in the fully closed position, wherein said platform further comprises releasable locking means for releasably locking the top portion of said first pair of legs in a desired location.

25. The foldable commode according to claim 24 wherein said releasable locking means releasably locks the top portion of said first pair of legs proximate the rear end of said platform in the fully closed position.

26. The foldable commode according to claim 24 wherein said releasable locking means releasably locks the top portion of said first pair of legs proximate the front end of said platform in the fully open position.

27. The foldable commode according to claim 26 wherein said releasable locking means further comprises at least one clamp.

28. The foldable commode according to claim 14 wherein the top portions of said first pair of legs are attached to each other.

29. The foldable commode according to claim 14 wherein said first pair of legs further comprises a connecting portion which connects the top portion of each of said first pair of legs and which is slidably disposed in the races.

30. The foldable commode according to claim 29 wherein said first pair of legs has a substantially U-shape.

31. The foldable commode according to claim 14 wherein said second pair of legs are attached to each other.

32. The foldable commode according to claim 14 wherein said second pair of legs further comprises a connecting portion which connects the top portion of each of said second pair of legs.

33. The foldable commode according to claim 32 wherein said second pair of legs has a substantially U-shape.

34. A foldable commode comprising:

a platform having a front end, a rear end, a top, and a bottom, said platform including a pair of slotted members depending from the bottom, each said slotted member defining a race extending from the front end to the rear end, said platform being provided with a through opening;

a first inverted U-shaped leg member having a pair of legs connected by a bight portion, each of said legs having a top portion, a middle portion, and a bottom portion, the bight portion being slidably disposed in the races;

a second inverted U-shaped leg member having a pair of legs connected by a bight portion, each of said legs having a top portion, a middle portion, and a bottom portion, the top portions being pivotally mounted on opposite sides of the rear end of said platform, wherein the middle portion of each of said legs of said second inverted U-shaped leg member is pivotally attached to the middle portion of a respective one of said legs of said first inverted U-shaped leg member;

a receptacle support means disposed intermediate the front and rear ends, said receptacle support means surrounding the through opening; and a receptacle which depends from said receptacle support means;

wherein, in a fully closed position, said first and second pairs of legs are disposed substantially adjacent said platform;

wherein, in a fully open position, said first and second pairs of legs generally criss-cross each other;

whereby the top portions of each of said leg means is prevented from separating from said platform; and whereby said foldable commode assumes a folded state when said first and second pairs of legs are in the fully closed position.

35. The foldable commode according to claim 34 further comprising a seat assembly pivotally attached to said platform.

36. The foldable commode according to claim 35 wherein said seat assembly includes a pivotable lid disposed on top of said seat.

37. The foldable commode according to claim 34 further comprising a pair of armrests disposed on top of said platform.

38. The foldable commode according to claim 37 further comprising a tissue roll holder attached to at least one of said armrests.

39. The foldable commode according to claim 34 further comprising releasably locking means for releasably locking the top portion of said pair of legs of said first inverted U-shaped leg member in a desired location.

40. The foldable commode according to claim 39, wherein said releasable locking means releasably locks the top portion of said first pair of legs proximate the rear end of said platform in the fully closed position.

41. The foldable commode according to claim 39, wherein said releasable locking means releasably locks the top portion of said first pair of legs proximate the front end of said platform in the fully open position.

42. The foldable commode according to claim 39, wherein said releasable locking means further comprises at least one clamp.

43. The foldable commode according to claim 34, wherein the top portion of said pair of legs of said first inverted U-shaped leg member extends substantially upward to form a back rest above the top of said platform in the fully open position.

* * * * *